US005328260A

United States Patent [19]

Beirise

[11] Patent Number: 5,328,260

[45] Date of Patent: Jul. 12, 1994

[54] MODULAR FURNITURE SYSTEM WITH WIRE MANAGEMENT

[75] Inventor: Jean Beirise, Cincinnati, Ohio

[73] Assignee: Herman Miller, Inc., Zeeland, Mich.

[21] Appl. No.: 696,510

[22] Filed: May 7, 1991

[51] Int. Cl.[5] ..... A47B 88/00

[52] U.S. Cl. ..... 312/223.6; 312/108

[58] Field of Search ..... 312/223, 107, 198, 194, 312/223.6, 196, 236, 108; 52/242; 108/50

[56] References Cited

U.S. PATENT DOCUMENTS

| | | | |
|---|---|---|---|
| 1,700,202 | 1/1929 | Langford . | |
| 1,700,203 | 1/1929 | Baker . | |
| 1,786,823 | 12/1930 | Carrington et al. . | |
| 2,821,450 | 1/1958 | Knoll | 312/211 |
| 2,930,665 | 3/1960 | Budai | 312/111 |
| 3,809,449 | 5/1974 | Beaver | 312/194 |
| 3,862,785 | 1/1975 | Scheerhorn et al. | 312/223 |
| 3,883,196 | 5/1975 | Mohr et al. | 312/194 |
| 3,922,045 | 11/1975 | Meyer | 312/108 |
| 3,964,401 | 6/1976 | Gutmann, Jr. et al. | 108/64 |
| 4,049,331 | 9/1977 | Gutmann, Jr. | 312/203 |
| 4,094,256 | 6/1978 | Holper et al. | 108/50 |
| 4,163,867 | 8/1979 | Breidenbach | 174/48 |
| 4,258,963 | 3/1981 | Fusselman et al. | 312/194 |
| 4,296,981 | 10/1981 | Hildebrandt | 312/194 |
| 4,323,291 | 4/1982 | Ball | 312/194 |
| 4,372,629 | 2/1983 | Propst et al. | 312/223 |
| 4,418,967 | 12/1983 | Winkelman, Jr. et al. | 312/107 |
| 4,433,630 | 2/1984 | Laborle | 108/50 |
| 4,570,156 | 2/1986 | Nicholas, Jr. | 340/547 |
| 4,619,486 | 10/1986 | Hannah et al. | 312/195 |
| 4,762,072 | 8/1988 | Boundy | 312/194 |
| 4,948,205 | 8/1990 | Kelley | 312/196 |
| 4,957,333 | 9/1992 | Hsu et al. | 312/108 |
| 5,016,947 | 5/1991 | Hsu et al. | 312/223 |

FOREIGN PATENT DOCUMENTS

| | | | |
|---|---|---|---|
| 0345754 | 12/1989 | European Pat. Off. . | |
| 512834A | 11/1992 | European Pat. Off. | 312/223.6 |
| 3142858 | 5/1983 | Fed. Rep. of Germany | 312/223 |
| 2482846 | 11/1981 | France . | |

OTHER PUBLICATIONS

"Space-Saver Bookcase/Desk", Reliable Home Office Catalog, Fall 1990, p. 40.

*Primary Examiner*—Kenneth J. Dorner
*Assistant Examiner*—Gerard A. Anderson
*Attorney, Agent, or Firm*—Willian Brinks Hofer Gilson & Lione

[57] ABSTRACT

An office furniture module comprising a body portion having a removable top portion adapted for mounting thereto in a spaced relationship with respect to an upper surface to define an upper horizontally extending passage way; one or more optionally removable upper insert panels adapted to be mounted between the removable top portion and the body portion; a bottom member also adapted for mounting to the body portion in a spaced relationship with respect to a lower end thereof to define a lower horizontally extending passage way between the bottom member and the lower end; and one or more optionally removable lower insert panels adapted to cover one or more respective openings in the body portion communicating with the lower horizontally extending passageway to enable the furniture module can be adapted for use with other like furniture modules to form a linearly extending course of furniture modules with horizontally extending passageways therethrough.

20 Claims, 3 Drawing Sheets

MODULAR FURNITURE SYSTEM WITH WIRE MANAGEMENT

BACKGROUND OF THE INVENTION

The present invention relates to office furniture and in particular the invention relates to office furniture systems and office furniture components that efficiently and advantageously combine features both of individual freestanding furniture pieces and of wall panel systems with hanging furniture and that include provision for top lay-in cable management.

Office furniture is typically available in individual freestanding pieces, such as desks, cabinets, bookcases, or in "hanging" furniture that attaches to wall panels or partitions. In an open floor plan office design, movable wall panels or partitions are used to define work spaces and provide visual and auditory privacy. Where such wall panel systems are used, hanging furniture (i.e. furniture that attaches to the panel system) has an advantage that it can be efficiently integrated into the design of the wall panel system. Wall panels may thus provide for the support of work surfaces, cabinets, shelving, and the like.

Although wall panel systems with hanging furniture can be efficiently utilized in many modern offices, in some modern offices the volume of items requiring storage can exceed the capacity of the cabinets, desks and other units that are provided by the wall panel system. Thus, the lack of adequate storage can become a significant problem. Lack of adequate storage can result in clutter and disorganization that is not only unaesthetic in appearance but also may result in costs associated with losing documents or other items, searching for misplaced documents or other items, and having to physically move to reach items routinely. Clutter can also be potentially hazardous to the office worker from the standpoint of falling over items placed on the floor. Clutter can also be potentially a fire hazard. Cluttered desks, floors, and shelves also are more difficult to clean or may take more time to clean thereby also possibly resulting in greater costs or less than thorough cleaning. Thus, there are numerous drawbacks and costs associated with cluttered offices and eliminating clutter can be very advantageous to a business.

Reducing clutter in an office requires places to put the items that constitute the clutter, i.e. adequate storage facilities. It is the lack of adequate storage, or storage that is convenient to use, that in many instances is at the root of the clutter problem. Adequate storage is thus a prerequisite to reducing disorganization and clutter in many offices.

In providing for adequate storage, it should be recognized that there are different types of storage to meet different needs. Primary or individual storage is the type of storage most often controlled by a individual worker. This type of storage would typically be located in the individual worker's immediate work space. This type of storage would be used by the individual worker on a daily basis or several times a day. This type of storage would be used for the individual worker's work-in-progress. Another type of storage includes secondary storage. This type of storage would be for items used less frequently or that relate to group activities. Yet another type of storage is archival. Archival storage may be accessible by the individual or by the group but would relate to items that would be consulted only occasionally. Other types of storage, e.g. off-site or remote storage, are typically outside the design of the office space. Such types of storage may accessed only rarely and then by having the material brought over by someone other than the individual.

Within these types of storage, there may be further subcategories. For example, in the primary personal storage category, there may be storage that is accessible from the individual's work place while seated and storage accessible by standing or taking a step.

In prior office systems, such as those that are designed around movable wall panels or partitions, the storage problem may be related in part to the limited storage capacity typically provided by such wall panel systems. With typical prior wall panel systems, the storage units are provided by attaching cabinets or other units to the wall panel. Such storage units may provide only limited capacity. Moreover, since such storage units may typically be designed around the wall panel system, they require the availability of a wall panel. If a wall panel is not available in the immediate area where needed, further storage may not be readily added there.

Although adequate storage is an important consideration in modern offices, another important consideration is the provision for adequate cable management. The distribution of wiring or cabling for electrical service, data and telephone is one of the most important and most rapidly evolving aspects of modern office design. In many modern office systems, it is essential to provide a high level of electrical, data, and communications service to workers for computers, laser printers, copying machines, fax machines, local area networks (including network servers), voice mail, video, and the like. Although the nature of these services vary, each imposes a requirement for providing cabling to the serviced office worker. Moreover, current trends suggest that these needs will continue and likely increase in the future.

In prior typical office systems designed around wall panels or partitions, one way that has been adapted for cable distribution is to use channels located in or under partition walls or panels. This prior approach has a number of disadvantages. For example, such channels may be limited by the dimensions of the wall panels. Thus, traditional wall panel systems typically provide only limited available cross sectional area for cabling. Moreover, even where wall panel systems have been adapted to accommodate cable distribution, often the cabling management channels are located along only the bottom portions of the wall panels or the same channel must be shared by electrical, telephone, and data cabling. Furthermore, in wall panel systems that provide channels for cabling, the channels are sometimes difficult to access thereby making it difficult to lay-in or replace cabling. Accordingly, there is a need for an office system that provides adequate cabling management for electrical, data, and telecommunications, and preferably that provides for separate passage ways for telephone and data cabling apart from the electrical cabling.

Yet another important consideration in modern offices relates to space utilization. With high rents in prime office buildings, it is essential to utilize office space as efficiently as possible. This can involve minimizing the area occupied by each individual office worker while at the same time providing the office worker with a functional work space area afforded with ample privacy and at least a perception of ample room. Typical prior office systems designed around wall panels or partitions do afford a level of privacy, that is limited ultimately by the dimensions of the wall panels, e.g. 2 to 3 inches in thickness.

Accordingly, it is an object of the present invention to provide the advantages of wall panel systems and additionally provide increased storage and cable management capability.

It is another object of the present invention to provide a furniture solution that is compatible with existing wall panel systems.

It is yet another object of the present invention to provide a furniture component that can be utilized in manner similar to wall panel systems and provide additional advantages relating to storage and cable management.

SUMMARY OF THE INVENTION

According to the present invention, there is provided an office furniture module comprising a body portion having a removable top portion adapted for mounting thereto in a spaced relationship with respect to an upper surface to define an upper horizontally extending passage way; one or more optionally removable upper insert panels adapted to be mounted between the removable top portion and the body portion; a bottom member also adapted for mounting to the body portion in a spaced relationship with respect to a lower end thereof to define a lower horizontally extending passage way between the bottom shelf and the lower end; and one or more optionally removable lower insert panels adapted to cover one or more respective openings in the body portion communicating with the lower horizontally extending passageway to enable the furniture module can be adapted for use with other like furniture modules to form a linearly extending course of furniture modules with horizontally extending passageways therethrough.

For purposes of this specification and appended claims, "like" furniture modules include furniture modules that are identical to each other, substantially identical to each other, are mirror images or substantially mirror images of each other. "Like" modules may occupy a uniform volume or near uniform volume or volumes that vary by standardized increments. "Like" modules may have uniform dimensions or have dimensions that vary by standardized increments (e.g. four, six, twelve, eighteen inches).

In this specification and appended claims, "cabling" includes any type of wiring, leads, connector, lines, fibers, or the like used for electrical, communications, or data transmissions or distribution.

DETAILED DESCRIPTION OF THE PRESENTLY PREFERRED EMBODIMENTS

Figure 1:
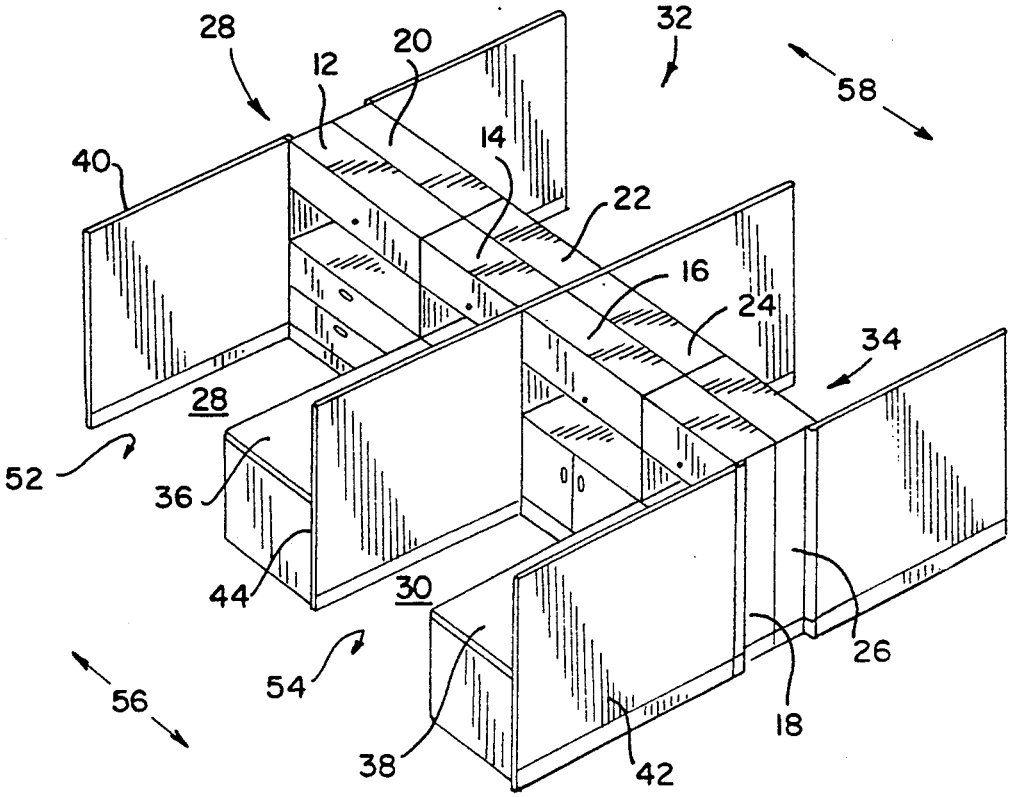
FIG. 1 is a perspective view of a plurality of furniture modules configured into a plurality of work stations incorporating aspects of one or more embodiments of the present invention.

Referring to FIG. 1, there is depicted a plurality of like furniture modules 12, 14, 16, 18, 20, 22, 24 and 26 arranged in a linear course to form a row 28. The furniture modules are uniform as to size and relative dimensions. In a preferred embodiment, the furniture modules are rectangular in shape. The furniture modules may be arranged so that each furniture module may be aligned with one or more like sized furniture modules with the vertical sides of adjacent furniture modules in proximity or connected together to form linear rows or courses. As described in this specification, adjacent furniture modules are understood to include furniture modules that have the vertically extending sides thereof in proximity and the vertically extending sides are understood to include the rear and front sides as well as the "right" and "left" sides. The row 28, as illustrated in FIG. 1, is formed of a first facing row of furniture modules 12, 14, 16, and 18 aligned adjacent to each other with their vertical "left" and "right" sides in proximity and a second facing row of furniture modules 20, 22, 24, and 26 aligned adjacent to each other with their vertical "left" and "right" sides in proximity. The vertical rear sides of the first facing row are in proximity, or connected to, the vertical rear sides of the second facing row.

As depicted in FIG. 1, the adjacent furniture modules 12 and 14 are connected together and are utilized in forming an office work station 28. Similarly, the furniture modules 16 and 18 are utilized in forming an office work station 30; the furniture modules 20 and 22 are utilized in forming an office work station 32; and the furniture modules 24 and 26 are utilized in forming an office work station 34.

Each of these office work stations may also typically include a horizontally extending work surface connected to a furniture module. For example, office work station 28 includes a horizontally extending work surface 36 that is connected to furniture module 14 and office work station 30 includes a horizontally extending work surface 38 that is connected to furniture module 18. In a preferred embodiment, the work surface in each office work station is arranged in a similar manner as in the adjacent office work station making up the linearly extending row of work stations. Thus, each work station occupies approximately the same area and has the same "footprint".

In addition, each office work station may also include one or more privacy screens associated therewith. The privacy screens separate a work station from an adjacent work station and afford a degree of visual and auditory privacy for a worker occupying the work station. For example, office work station 28 includes a privacy screen 40 that is connected to furniture module 12 and office work station 30 includes a privacy screen 42 that is connected to furniture module 18. The privacy screen 44 is connected between furniture modules 14 and 16 and provides for privacy between work station 28 and 30.

Each of these work stations occupies an area defined by the linearly extending row 28 of furniture modules. The work surfaces and the privacy partitions may further define each of the work station areas. As depicted in FIG. 1, the work stations 28 and 30 have open sides, 52 and 54 respectively, opposite to the linearly extending row 28 of furniture modules. The open sides of adjacent work stations would typically face a linearly extending aisle 56 that runs parallel to the linearly extending row 28 of furniture modules to enable access to the work stations 28 and 30. Similarly, work stations 32 and 34 would also typically have open sides opposite the linearly extending row 28 but facing in an opposite direction and would open to another linearly extending aisle 58 also parallel to the linearly extending row 28. Although only four work stations are depicted in FIG. 1, it is understood that the linearly extending row may include many more work stations formed by additional furniture modules. The office work stations formed by the linearly extending row of furniture modules may be formed on both sides of the row, as depicted in FIG. 1, or on only one side of row, or may be formed of a combination thereof. If office work stations are formed on only side of the row, the row may be formed by a single row of adjacent furniture modules positioned with the right and left vertical sides of adjacent furniture modules in proximity. However, if office work stations are formed on only side of the row, the row may also be formed by a double row of adjacent furniture modules positioned with the rear vertical sides as well as the right and left vertical sides of adjacent furniture modules in proximity.

An office work space may include a plurality of such linearly extending rows of furniture modules. Such a plurality of rows may be similar or identical as to the number of work stations, and the dimensions thereof, or may have work stations of different dimensions, e.g. formed of three or four furniture modules instead of two, to be adapted to different office worker tasks. Such a plurality of rows may be arranged parallel to each other, for example to share adjacent aisles, or may be arranged in different configurations.

The linearly extending row 28 also includes a provision for cable management. Each of the furniture modules that form the linearly extending row includes one or more cable management channels that may be aligned and adapted with the cable management channel of an adjacent furniture module to form a cable management channel for the row that can extend the length of the row and that can serve each of the office work stations formed by the linearly extending row.

Figure 2B:
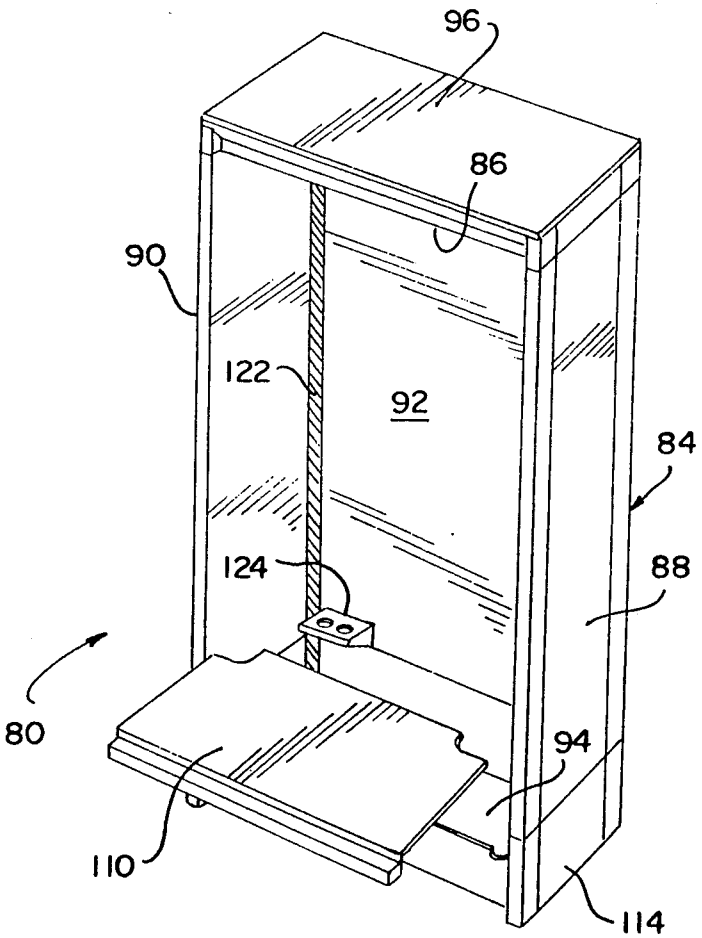
FIG. 2*b* is a perspective view of a front side of the single furniture module depicted in the embodiment of FIG. 2*a*.
Figure 2A:
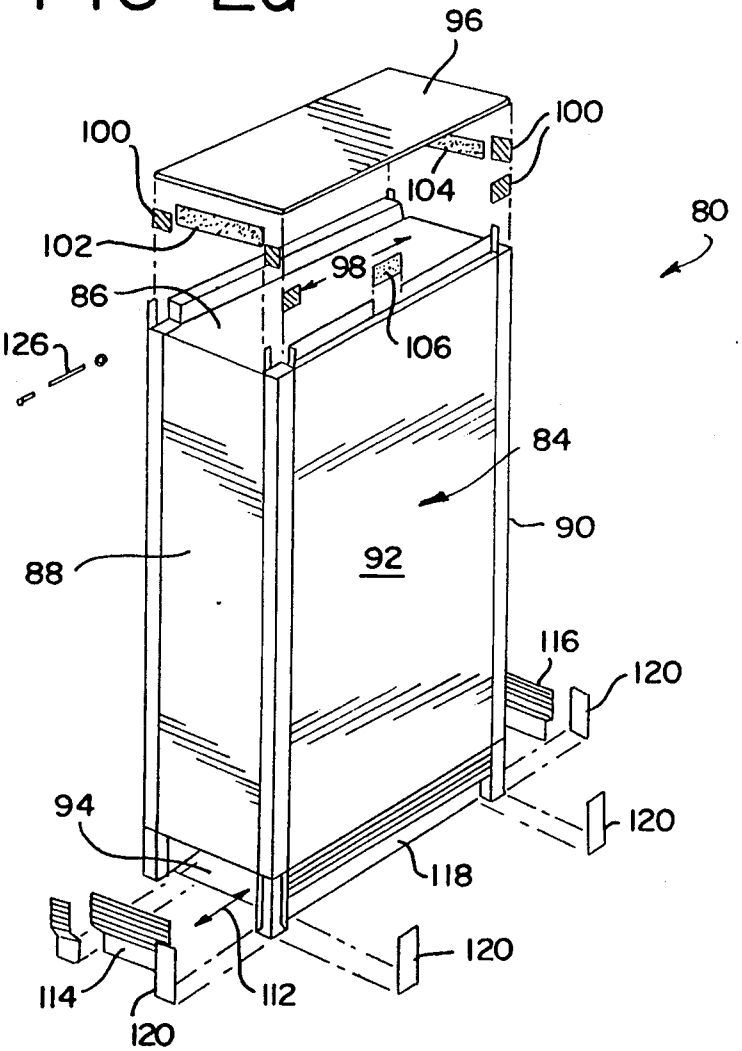
FIG. 2*a* is an exploded, perspective view of a rear side of a single furniture module as depicted in an embodiment of FIG. 1.

Referring to FIGS. 2*a* and 2*b*, there is depicted a single furniture module 80 incorporating features of a presently preferred embodiment. This furniture module 80 is similar to the furniture modules 12, 14, 16, 18, 20, 22, 24, and 26 of FIG. 1. The furniture module 80 includes a body portion 84 that is preferably rectangular in configuration. The body portion 84 includes an upper surface 86, a first vertical side 88 extending down from the upper surface 86 and a second vertical side 90 opposite from the first vertical side 88 and also extending down from the upper surface 86. The body portion 84 also includes a rear vertical side 92 that extends down from the upper surface 86 and that also extends horizontally from the first vertical side 88 to the second vertical side 90. The first and second vertical sides 88 and 90, and the rear vertical side 92, are generally flat and can be positioned to face similar generally flat sides of adjacent like-sized furniture modules so as to form a linear course of furniture modules, as explained above. The body portion 84 may also include a front side, not shown in FIGS. 2*a* and 2*b*. The front side may include flat panels forming portions of doors, drawers, shelves, etc., or the front side may be open, as depicted in FIG. 2*b*, or may be formed of a combination of an open portion and one or more flat panels. The body portion 84 may also include a lower surface 94 or the bottom of the body portion 84 may be open. The lower surface 94, if provided, is oppositely located from the upper surface 86.

The body portion 84 comprise a volume defined by the first vertical side 88, the second vertical side 90, the rear vertical side 92, the front vertical side, the upper surface 86, and the lower end or surface 94.

The furniture module typically comes in standard sizes so as to be readily formed into rows, such as depicted in FIG. 1. For example, the module may be 24, 30, 36, or 42 inches wide, 15, 21 or 24 inches deep, and 40½, 54½, 63½, or 68½ inches in height. By making the modules in standard sizes, with different sizes varying by standard multiples, the modules can be readily configured into rows to form work stations of similar dimensions.

Referring again to FIGS. 2*a* and 2*b*, the furniture module 80 also includes a top portion 96 adapted for mounting to said body portion 84. The top portion 96 is adapted to be connected to the body portion 84 in a spaced relationship with respect to the upper surface 86 to define an upper horizontally extending passage way 98 above the upper surface 86 between the top portion 96 and the upper surface 86. In a preferred embodiment the top portion 96 is readily removable to facilitate laying-in of cabling.

The top portion 96 may be positioned on the body portion 84. Corner caps 100 may be provided and located at the four corners of the top portion 96 adjacent to the four corners of the upper surface 86. The furniture module further includes one or more upper insert panels. For example, a first upper insert panel 102 is adapted to be mounted between the top portion 96 and the body portion 84 at a side thereof generally aligned with the first vertical side 88. A second upper insert panel 104 is adapted to be mounted between the top portion 96 and the body portion 84 at a side thereof generally aligned with the second vertical side 90. A third upper insert panel 106 is adapted to be mounted between the top portion 96 and the body portion 84 at a side thereof generally aligned with the rear vertical side 96.

As described above, the furniture module 80, when utilized with other like sized furniture modules to form a linearly extending row, also provides for cable management. When a furniture module, such as module 80, is so utilized, one or more of the upper panel inserts 102, 104, and 106, may be removed so that when adjacent furniture modules are in proximity, the upper horizontally extending passage ways of the furniture modules are aligned and communicate with each other thereby forming an upper horizontally extending passageway that can extend through the entire length of the linearly extending row of modules. The third upper panel insert 106 aligned with the rear vertical side of the body portion 84 may be removed to enable communication between the cable management channels in adjacent oppositely facing rows. Optionally, one or more upper panel inserts may be left in place in the furniture module if, for example, the module forms the terminus of a linearly extending row. Because the top portion 96 is preferably removable, direct laying-in of cabling into the linearly extending upper cable management channel is facilitated by removal of the top portions of the modules that make up the linearly extending row.

Another advantage provided by the embodiment of FIGS. *2a* and *2b* is that the entire depth of the module is available for cable management. Thus, excess cable can be readily stored in the linearly extending cable management channel. Excess lengths of cable do not have to stuffed under or behind desks or work surfaces. This can further reduce clutter and help provide a clear work area.

In a preferred embodiment, the furniture module 80 also includes a bottom member 110 adapted for mounting inside the body portion 84. The bottom member 110 is adapted to be connected to the body portion 84 at a location between the first and second vertical sides in a spaced relationship with respect to the lower end or surface 94 to define a lower horizontally extending passage way 112 above the lower end or surface 94 between the bottom member 110 and the lower end or surface 94. The bottom member 110 may be a shelf, as illustrated in FIG. *2b*, or may be a file, drawer, or the like. In a preferred embodiment the bottom member is readily removable to facilitate threading-in or laying-in of cabling.

The furniture module 80 further includes one or more lower insert panels. These lower insert panels are adapted to cover lower openings in the body portion 84. These lower openings in the body portion 84 are located in lower portions of the vertical sides and communicate with the lower extending passage way 112. The lower opening may be formed for example by a lower end of first vertical side 88 being in a spaced relationship with the floor, a lower end of the body portion 84, or the lower surface 94, as depicted in FIG. *2a*. In the embodiment of FIGS. *2a* and *2b*, a first lower insert panel 114 is adapted to cover a first lower opening in the body portion 84 at a bottom end of the first vertical side 88. A second lower insert panel 116 is adapted to cover a second lower opening in the body portion 84 at a bottom end of the second vertical side 90. A third lower insert panel 118 is adapted to cover a third lower opening in the body portion 84 at a bottom end of the rear vertical side 92. The first lower insert panel 114 is generally aligned with the first vertical side 88, the second lower insert panel 116 is generally aligned with the second vertical side 90, and the third lower insert panel 118 is generally aligned with the rear vertical side 92.

As described above, when a furniture module, such as module 80, is utilized with other like sized furniture modules to form a linearly extending row, cable management may be provided by means of a horizontally extending lower passage way for cable management. A horizontally extending lower passage way for cable management may be provided by removing one or more of the lower panel inserts, for example 114, 116, or 118, so that when adjacent furniture modules are in proximity, the lower horizontally extending passage ways of the furniture modules are aligned and communicate with each other thereby forming an lower horizontally extending passageway that can extend through the entire length of the linearly extending row of modules. The third lower panel insert 118 aligned with the rear vertical side of the body portion 84 may be removed to enable communication between the cable management channels in adjacent oppositely facing rows. Optionally, one or more lower panel inserts may be left in place in the furniture module if, for example, the module forms the terminus of a linearly extending row.

The body portion 84 may additionally include one or more lower corner caps 120. These lower corner caps 120 are located at the lower corners of the body portion and may be adapted to facilitate holding the removable lower panel inserts 114, 116, and 118 in place or may be removable to enable cable passage from a cabinet to a wall panel.

The body portion of a module may be provided with additional openings into the horizontally extending lower passage way in order to provide access for floor monuments to bring cabling into a row of modules from, for example, a subfloor conduit.

Also located in the body portion 84 are one or more vertical wire channels, such as vertical wire channel 122. The vertical wire channel 122 extends between and communicates with the upper horizontally extending passage way 98 and the lower horizontally extending passage way 112. Cabling can be extended from one passage way to the other passage way. The vertical wire channel 122 is preferably located inside the body portion 84 at the vertical intersection of the rear vertical side 92 and the second vertical side 90. Another vertical wire channel (not shown) may be located inside the body portion 84 at the vertical intersection of the rear vertical side 92 and the first vertical side 88.

There may also optionally be provided an electrical outlet receptacle 124 located inside the body portion 84 adjacent to the vertical channel 122. In the embodiment of the module shown in FIG. *2b*, the receptacle 124 is preferably located adjacent to and above the bottom member 110.

In preferred embodiment, each of the modules is provided with both an upper cable management passage way and a lower cable management passage way in order that the linearly extending row of modules have both an upper passage way and a lower passage way. Due to code restrictions, the lower passage way is preferably used only for electrical cable distribution and the upper passage way is used for data and communications distribution. By placing the telecommunications and data cabling in the upper passage way, they can be substantially isolated from the electrical cabling transmission in the lower passage way thereby reducing electromagnetic interference therefrom. On the other hand, the utilization of the passage ways need not be entirely exclusive, and electrical, data and communications cabling may occupy the same passageway consistent with any national or local codes or other requirements for shielding, isolation, etc. The vertical channel may be used for bringing cabling to the level of a work surface. The vertical channel may be provided with one or more opening at appropriate locations to enable bringing cabling to a horizontal work surface.

The upper or lower passage ways, or both, may be provided with electromagnetic shielding. This may be built into the body portion, the bottom member, the top portion, or any combination thereof.

As mentioned above, in some prior office work station systems partition walls are employed or adapted to include cables to distribute power, communications and data. With the embodiment of the present invention shown in FIG. 1, cabling may be located in upper or lower passage ways. With the embodiment shown in FIG. 1, a considerably greater cross sectional area is available for running cabling to work stations than is typically available by wall panel systems alone. As shown, the entire top end of the furniture module is available for cabling thereby providing a much greater capacity relative to typical prior wall panel systems. Moreover, because the top portions and bottom members of each module are removable, access to the cabling passage way is considerably easier than with prior panel systems. This facilitates running in new cabling or replacing old cabling to meet changing requirements. In addition, because the modules that make up the linearly extending row are considerably thicker than typical prior wall panels, the described embodiment affords greater visual and auditory privacy.

A means for attaching adjacent modules, such as nut and bolt assembly 126, may be used to rigidly connect adjacent furniture modules when forming a linearly extending row of modules. Rigid connection of adjacent modules may be preferred or required under some codes when electrical or other cabling is run from the cable management channels of one module to the channels of an adjacent module. Alternative attaching means may include pins, latches, hooks, fasteners, and the like.

Figure 3:
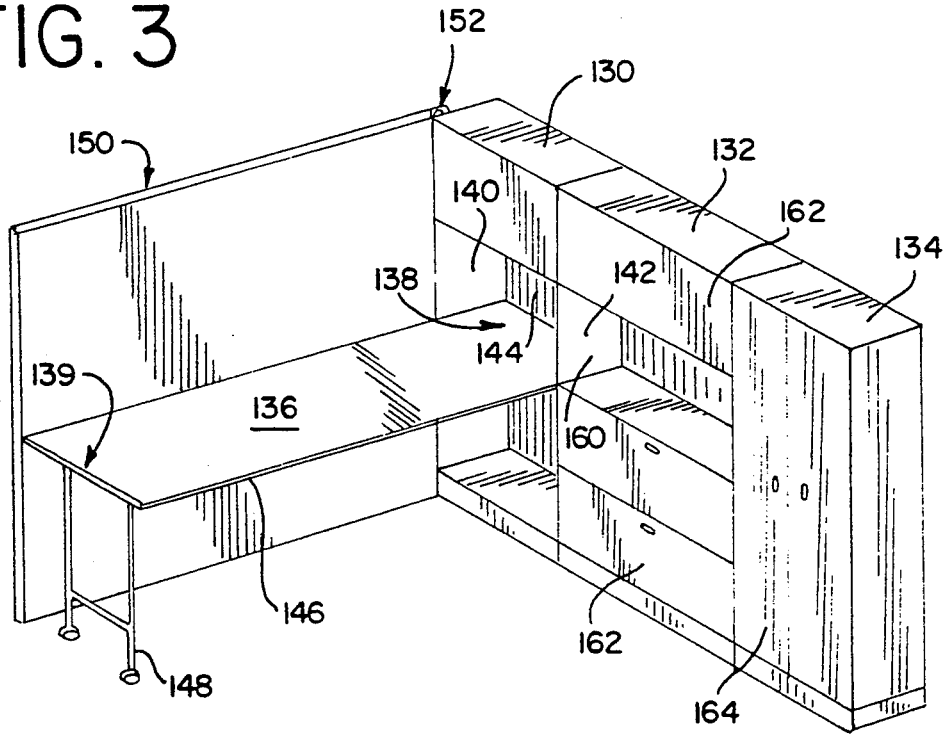
FIG. 3 a perspective view of a single work station including a plurality of furniture modules of an embodiment of the present invention.

Referring to FIG. 3, there is depicted an embodiment of one work station formed of three furniture modules, 130, 132, and 134. As mentioned above, a work station may be formed of a different number of work station modules, such as two as shown in FIG. 1 or three as shown in FIG. 3, or another number. A work surface 136 is associated with the office work station. The work surface 136 is a horizontally extending generally rectangular surface with a first end 138 and a second end 139. The first end 138 of the work surface is connected to the furniture module 130. The work surface 136 is attached to the module 130 so that the first end 138 is located in the module 130 between a first vertical side 140 and a second vertical side 142 thereof. The first end 138 may preferably extend all the way to an inside surface of a rear vertical side 144 thereof. At or near the first end 138 of the work surface, access is preferably provided to a vertical channel in order to provide cabling to the work surface for office equipment.

The work surface 136 extends in a perpendicular direction from the rear vertical side 144 out of the module 130 so that the second end 139 is located out of and spaced from the module 130 thereby providing a portion of the work surface extending out of the module 130 suitable for use by an office worker as a desk. For example, in the work station depicted in FIG. 3, a worker may position a chair (not shown) adjacent edge 146 to use the work surface 136 as a desk top. A work surface support member 148 may be provided to help support the work surface 136. The support member 148 may be in the form of legs connected to an underside of the work surface 136 toward the second end 139.

The work station depicted in FIG. 3 may also include a screen 150. The screen may be in the form of a wall panel or partition. The screen 150 may be connected to module 130 by means of a panel connector 152 and extend parallel and adjacent to the work surface 136. The screen 150 may be of a height sufficient to provide visual privacy for a worker located at the work surface 136. The screen 150 may also provide for auditory privacy. If the work station forms part of a linearly extending row, additional screens similar to screen 150, may be provided between each work station, as depicted in FIG. 1.

In a preferred embodiment of the present invention, a significant advantage is provided by the panel connector 152. The panel connector 152 makes the furniture modules compatible with a wall panel system. This permits the furniture modules to be incorporated into wall panel systems. According to a preferred embodiment, an office design can use both hanging furniture units as well as free standing furniture modules. Thus, where large storage capacity is required, furniture modules, such as modules 130, 132, and 134 can be used. On the other hand, where a lesser degree of storage is required, hanging furniture can be used. Also, because the furniture modules are preferably compatible with a wall panel system, furniture modules can be retrofitted into an existing wall panel system designed to meet the growing storage needs of a business.

Another significant advantage of the arrangement of modules and work surface in the work station depicted in FIG. 3 is that a substantial volume of storage is provided to the office worker using the work station and importantly that the storage is of different types. For example, the worker has a considerable volume of active storage located at the first end 138 of the work surface and extending to the area immediately adjacent thereto in the module 132. This area of active storage is indicated by the numeral 160. This arrangement also provides a considerable volume of intermediate storage adjacent to the area of active storage. This area of intermediate storage is indicated by the numeral 162. The work station arrangement also provides for an area of peripheral storage. This is marked by the numeral 164.

Figure 4A:
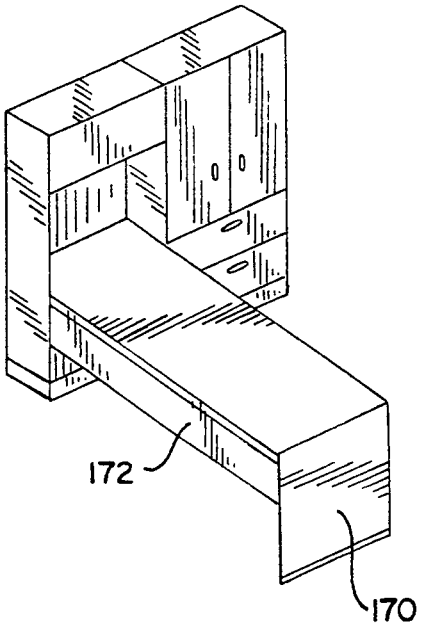
FIG. 4*a* a perspective view of a single work station including a plurality of furniture modules of another embodiment of the present invention.
Figure 4B:
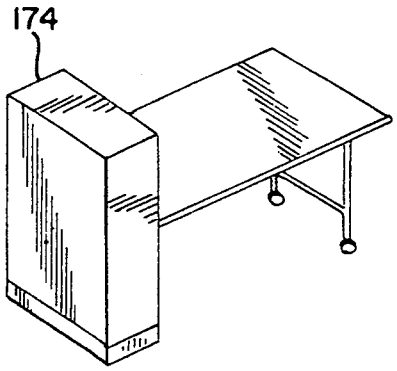
FIG. 4*b* is a perspective view of a single work station including a plurality of furniture modules of yet another embodiment of the present invention.

Referring to FIGS. 4*a* and 4*b*, there are illustrated alternative embodiments of work stations, or portions thereof, formed of furniture modules and horizontally extending work surfaces incorporating aspects of the present invention. In FIG. 4*a*, a support member for the work surface is provided by an end panel 170 and a modesty panel 172. FIG. 4*b* shows an embodiment utilizing only a single furniture module 174.

The embodiments of FIGS. 4*a* and 4*b* illustrate that the furniture module and work surface have the versatility to be utilized in a private office environment as well as in an open plan office floor space. This provides the significant advantage that a business can utilize the same pieces in both the private offices and in the open plan sections. This has aesthetic benefits as well as practical benefits. Moreover, because the insert panels which are removed when the modules are used in rows in an open plan design can be reinstalled at a later time, these pieces have the significant advantage of having the capability of being reconfigured to meet changing needs of a business.

Figure 5:
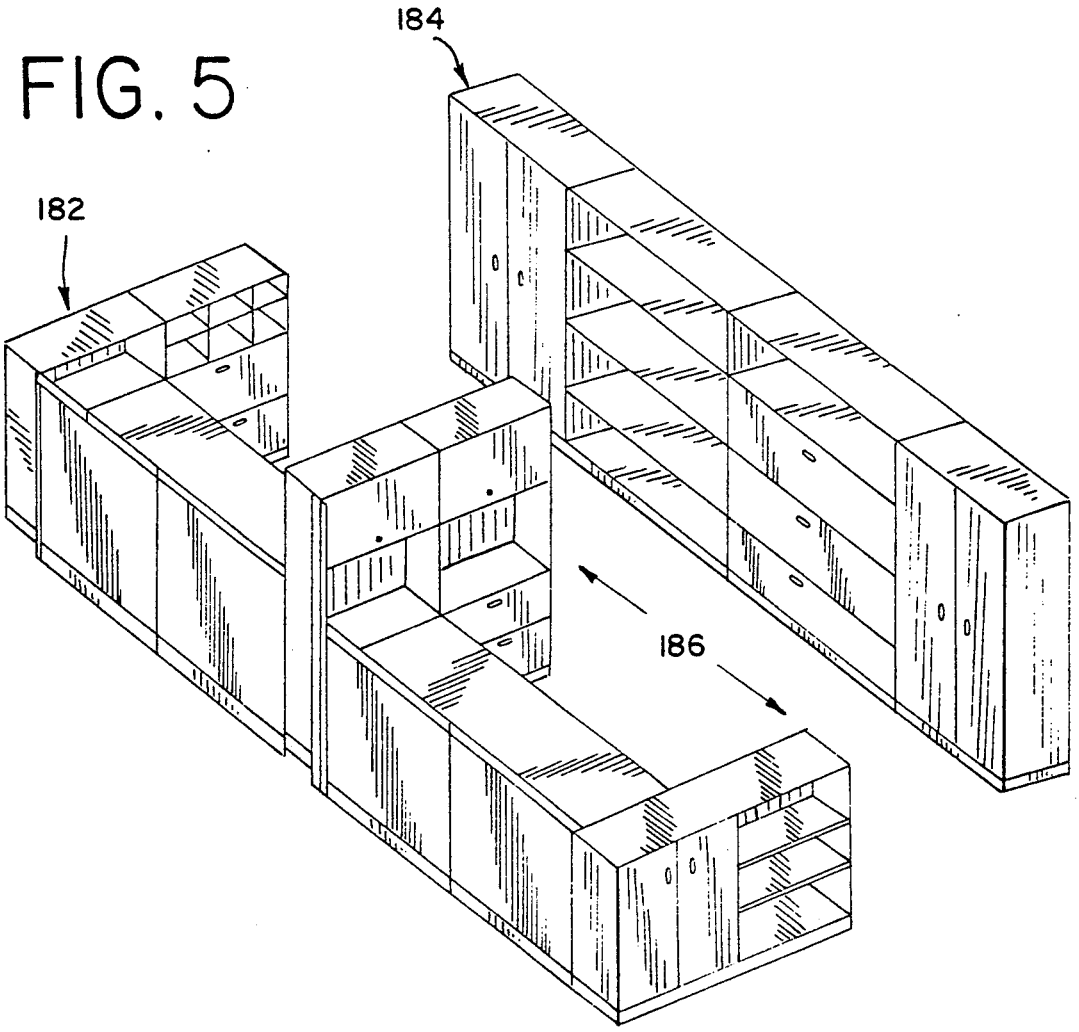
FIG. 5 is a perspective view of a plurality of furniture modules embodying aspects of one or more embodiments of the present invention.

Referring to FIG. 5, there is depicted another embodiment incorporating features of the present invention. In FIG. 5, a plurality of furniture modules are arranged in rows 182 and 184 with an aisle 186 therebetween. The linearly extending rows 182 and 184 include furniture modules provided without work surfaces or privacy partitions. These modules are not arranged to form work stations per se. Instead, the modules are arranged to form storage areas without work surfaces. An office work space may thus also include one or more linearly extending rows of furniture modules that are not formed into work stations. Such furniture modules may be used for shelving, cabinets, and storage apart from being associated with a single work station. These areas may be located close to work stations to provide additional storage capacity. The storage provided by the modules shown in FIG. 5 may be for group storage requirements, i.e., for the storage of documents or items not specifically related to an individual worker and thus not in the worker's individual work space. The arrangements of modules shown in FIG. 5, because they are formed of like modules as those used to form work stations such as shown in FIG. 1, would be inherently compatible with the rows of work stations. For example, these arrangements of modules in FIG. 5 would be able to provide cable management therethrough or to continue a run of cabling with a row of work stations made up of furniture modules. Alternatively, linearly extending rows may be made up of combinations of furniture modules used to form work stations and furniture modules not used to form work stations.

It is intended that the foregoing detailed description be regarded as illustrated rather than limiting and that it is understood that the following claims including all equivalents are intended to define the scope of the invention.

I claim:

1. An office furniture system comprised of:

a plurality of like-sized furniture modules each module including:

first and second generally flat sides that can be positioned to face similar generally flat sides of adjacent like-sized furniture modules so as to form a linear course of furniture modules said first and said second flat sides each having an aperture located therein;

and further in which each furniture module in said course includes:

a cabinet portion; and an open passageway located therewithin extending from said first flat side to said second flat side and located vertically adjacent to said cabinet portion, said open passageway alignable with at least one passageway in an adjacent like-sized furniture module so as to provide for an open passageway extending through said course via the apertures located in facing flat sides of adjacent modules for the distribution of cabling through, between and among said plurality of like-sized furniture modules;

an optional insert panel adapted to cover the aperture in one of said flat sides to close off said passageway when said one flat side serves as a terminus of said linear course of furniture modules; and one or more fastening apparatus for mechanically fastening adjacent like-sized furniture modules to each other.

2. The office furniture system of claim 1 further including one or more work surfaces, each work surface extending from a location between said first flat side and second flat side of a furniture module in a direction generally perpendicular to said course.

3. The office furniture system of claim 1 further comprising:

one or more wall panel units; and a connection apparatus for connecting said one or more wall panel units to one or more of said furniture modules.

4. The office furniture system of claim 1 in which said at least one open passageway in each furniture module comprises:

a lower passageway located generally along a lower end of each of said furniture modules, said lower passageway extending from said first flat side to said second flat side and alignable with a lower passageway in an adjacent like-sized furniture module so as to provide for an open lower passageway extending through said course for the distribution of cabling through, between and among said modules.

5. The office furniture system of claim 1 in which said at least one open passageway in each furniture module comprises:

an upper passageway located generally along a upper end of each of furniture module, said upper passageway extending from said first flat side to said second flat side and alignable with an upper passageway in an adjacent like-sized furniture piece so as to provide for an open upper passageway extending through said course for the distribution of cabling through, between and among said modules.

6. The office furniture system of claim 5 further comprising:

a lower passageway located generally along a lower end of each furniture module, said lower passageway extending from said first flat side to said second flat side and alignable with a lower passageway in an adjacent like-sized furniture module so as to provide for an open lower passageway extending through said course for the distribution of cabling through, between and among said modules.

7. An office furniture system comprised of:

a plurality of like-sized cabinet units each cabinet unit having first and second generally flat sides that can be positioned to face similar generally flat sides of adjacent like-sized cabinet units so as to form a linear course of cabinet units, said first and said second flat sides each having an aperture located therein that extends substantially across said flat side;

and further in which each of said plurality of cabinet units in said course includes:

a cabinet portion extending from said first flat side to said second flat side; and an open passageway located therewithin extending from said first flat side to said second flat side and located vertically adjacent to said cabinet portion, said open passageway alignable with at least one passageway in an adjacent like-sized cabinet unit so as to provide for an open passageway extending through said course for the distribution of cabling through, between and among said plurality of like-sized cabinet units; and one or more fastening apparatus for fastening adjacent like-sized cabinet units to each other.

8. An office furniture module comprising:

a body portion having an upper surface, a first vertical side extending down from the upper surface, a second vertical side opposite from said first vertical side and extending down from the upper surface, and a rear vertical side connected to and extending from said first vertical side to said second vertical side, said rear vertical side also extending down from the upper surface;

a removable top portion adapted for mounting to said body portion in a spaced relationship with respect to said upper surface thereof to define an upper horizontally extending passage way located above said upper surface between said top portion and said upper surface;

a first optionally removable upper insert panel adapted to be mounted between said removable top portion and said body portion at a side thereof generally aligned with said first vertical side;

a second optionally removable upper insert panel adapted to be mounted between said removable top portion and said body portion at a side thereof oriented in the direction of said second vertical side and generally aligned therewith;

whereby the furniture module can be adapted for use with other like furniture modules to form a linearly extending course of furniture modules with the upper horizontally extending passageway of a furniture module communicating with the upper horizontally extending passageway of an adjacent furniture module for extending cabling therealong by the removal of facing upper insert panels of the adjacent furniture modules.

9. The furniture module of 8 claim further comprising:

a horizontal work surface connected at a first end thereof to said body portion and extending from a location between said first vertical side and said second vertical side in a direction generally perpendicular to said rear vertical side.

10. The furniture module of claim 9 further comprising:

a work surface support connected to a lower side of said horizontal work surface at a second end thereof and extending downward.

11. The office furniture module of claim 8 further comprising:

a lower end of said body portion located opposite from said upper surface;

a bottom member adapted for mounting to said body portion in a spaced relationship with respect to said lower end thereof to define a lower horizontally extending passage way above said lower end between said bottom member and said lower end;

a first optionally removable lower insert panel adapted to cover a first lower opening in said body portion in said first vertical side communicating with the lower horizontally extending passageway;

a second optionally removable lower insert panel adapted to cover a second lower opening in said body portion in said second vertical side communicating with the lower horizontally extending passageway; whereby the furniture module can be adapted for use with other like furniture modules to form a linearly extending course of furniture modules with the lower horizontally extending passageway of a furniture module communicating with the lower horizontally extending passageway of an adjacent furniture module for extending cabling therealong by the removal of facing lower panel inserts of the adjacent furniture modules.

12. The furniture module of claim 11 further including:

a vertical wire channel located in said body portion and extending between and communicating with the upper horizontally extending passage way and the lower horizontally extending passage way whereby cabling can be extended from one passage way to the other passage way.

13. The furniture module of claim 12 in which said vertical wire channel is located at the intersection of said rear vertical side and one of said first and second vertical sides.

14. The furniture module of claim 11 in which said bottom member is removable.

15. An office furniture system comprised of:

a plurality of like-sized furniture modules each of said plurality of like-sized furniture modules comprising:

a body portion having an upper surface, a first vertical side extending down from the upper surface, a second vertical side opposite from said first vertical side and extending down from the upper surface, and a rear vertical side connected to and extending from said first vertical side to said second vertical side, said rear vertical side also extending down from the upper surface;

a removable top portion adapted for mounting to said body portion in a spaced relationship with respect to said upper surface thereof to define an upper horizontally extending passage way above said upper surface between said top portion and said upper surface;

a first optionally removable upper insert panel adapted to be mounted between said removable top portion and said body portion at a side thereof generally aligned with said first vertical side;

a second optionally removable upper insert panel adapted to be mounted between said removable top portion and said body portion at a side thereof oriented in the direction of said second vertical side and generally aligned therewith; and one or more connection apparatus for connecting adjacent like-sized furniture modules to each other.

16. The office furniture system of claim 15 further including:

one or more wall panel units; and a connection apparatus for connecting said one or more wall panel units to one or more of said furniture modules.

17. An office furniture module comprising:

a body portion having a lower end, a first vertical side extending up from the lower end, a second vertical side opposite from said first vertical side and extending up from the lower end, and a rear vertical side connected to and extending from said first vertical side to said second vertical side, said rear vertical side also extending up from the lower end;

a bottom member adapted for mounting to said body portion in a spaced relationship with respect to said lower end thereof to define a lower horizontally extending passageway located above said lower end between said bottom member and said lower end;

a first optionally removable lower insert panel adapted to cover a first lower opening in said body portion in said first vertical side communicating with the lower horizontally extending passageway; and a second optionally removable lower insert panel adapted to cover a second lower opening in said body portion in said second vertical side communicating with the lower horizontally extending passageway;

whereby the furniture module can be adapted for use with other like furniture modules to form a linearly extending course of furniture modules with the lower horizontally extending passageway of a furniture module communicating with the lower horizontally extending passageway of an adjacent furniture module for extending cabling therealong by the removal of facing lower panel inserts of the adjacent furniture modules.

18. The furniture module of claim 17 in which said bottom member is removable.

19. An office furniture system comprised of:

a plurality of like-sized furniture modules as set forth in claim 17; and one or more connection apparatus for connecting adjacent like-sized furniture modules to each other.

20. The office furniture system of claim 19 further including:

one or more wall panel units; and a connection apparatus for connecting said one or more wall panel units to one or more of said furniture modules.

* * * * *

UNITED STATES PATENT AND TRADEMARK OFFICE

CERTIFICATE OF CORRECTION

PATENT NO. : 5,328,260

DATED : July 12, 1994

INVENTOR(S) : Jean Beirise

It is certified that error appears in the above-indentified patent and that said Letters Patent is hereby corrected as shown below:

On the Title Page

In the Abstract lines 4-5 delete "pas-sage way" and substitute --passageway--; lines 10-11 delete "passage way" and substitute --passageway--; line 16 delete "can" and substitute --to--.

In the Claims

Column 12:

In claim 5, line 5, delete the second occurrence of "of".

In claim 8, line 13, delete "passage way" and substitute --passageway--.

Column 13:

In claim 9, line 1, delete "8 claim" and substitute --claim 8--.

In claim 11, line 8, delete "passage way" and substitute --passageway--.

In claim 12, lines 5-8, delete each occurrence of "passage way" and substitute --passageway--.

UNITED STATES PATENT AND TRADEMARK OFFICE

CERTIFICATE OF CORRECTION

PATENT NO. : 5,328,260

DATED : July 12, 1994

INVENTOR(S) : Jean Beirise

It is certified that error appears in the above-indentified patent and that said Letters Patent is hereby corrected as shown below:

Column 14:

In claim 15, line 16, delete "passage way" and substitute --passageway--.

Signed and Sealed this

Sixth Day of June, 1995

*Attest:*

*Attesting Officer*

BRUCE LEHMAN

*Commissioner of Patents and Trademarks*